United States Patent [19]

Bammel

[11] Patent Number: 4,597,838

[45] Date of Patent: Jul. 1, 1986

[54] ADDITIVE AGENT FOR ZINC ALLOY ELECTROLYTE AND PROCESS

[75] Inventor: Brian D. Bammel, Canton, Mich.

[73] Assignee: OMI International Corporation, Warren, Mich.

[21] Appl. No.: 770,447

[22] Filed: Aug. 29, 1985

[51] Int. Cl.[4] ..... C25D 3/56

[52] U.S. Cl. ..... 204/44.2

[58] Field of Search ..... 204/44.2, 44.5, 55 R, 204/114, 123

[56] References Cited

U.S. PATENT DOCUMENTS

| | | | |
|---|---|---|---|
| 4,170,526 | 10/1979 | Creutz | 204/55 R |
| 4,176,017 | 11/1979 | Martin | 204/55 R |
| 4,207,150 | 6/1980 | Creutz et al. | 204/55 R |

FOREIGN PATENT DOCUMENTS

| | | | |
|---|---|---|---|
| 136793 | 8/1983 | Japan | 204/55 R |

*Primary Examiner*—G. L. Kaplan

*Attorney, Agent, or Firm*—Richard P. Mueller

[57] ABSTRACT

An improved aqueous acidic electrolyte suitable for electrodepositing zinc alloys comprising a combination of zinc and at least one metal selected from the group consisting of nickel, cobalt, iron, and mixtures thereof incorporating an effective amount of an additive agent for providing improved grain-refinement and enhancing the codeposition of the alloying metals in the zinc alloy deposit. The additive agent comprises a bath soluble anionic carboxylated polyoxyalkylene compound derived from the carboxylation of:

(a) the polymerization of alkylene oxides selected from the group consisting of ethylene oxide, propylene oxide, glycidol, butylene oxide and mixtures thereof; and (b) the alkoxylation of mono and polyhydroxy compounds selected from the group consisting of hydroxyl containing alkyl, alkenyl, alkynyl, aryl, as well as mixtures thereof.

The present invention further encompasses the process of employing the aforementioned electrolyte for the deposition of functional and decorative zinc-alloy electrodeposits.

20 Claims, No Drawings

ADDITIVE AGENT FOR ZINC ALLOY ELECTROLYTE AND PROCESS

BACKGROUND OF THE INVENTION

The present invention broadly relates to an improved electrolyte and process for elecrodepositing zinc alloys, and more particularly, to an improved aqueous acid zinc alloy electrolyte containing an improved additive agent for providing improved grain-refinement, reduced dendrite formation, increased adhesion and ductility and an unexpected increase in the codeposition of one or more alloying metals in the zinc alloy deposit.

Electrolytes incorporating zinc ions in further combination with one or a combination of nickel, cobalt, iron or mixtures thereof have heretofore been used or proposed for use for depositing zinc alloy platings of a decorative or functional type on a variety of substrates such as iron and steel, for example, to provide for improved corrosion resistance, enhance appearance and/or to build up the surface of a worn part enabling refinishing thereof to restore its original operating dimensions. Such zinc alloy electrolytes and processes are in wide-spread commercial use for industrial or functional plating including strip plating, conduit plating, wire plating, rod plating, tube plating, coupling plating, and the like. A continuing problem associated with such prior art zinc alloy electrolytes has been the inability to achieve the desired grain-refinement of the alloy electrodeposit to provide the requisite semi-bright appearance and associated physical properties including adhesion and ductility. A further problem has been the inability to increase the percentage of the alloying metal constituent such as nickel, cobalt and/or iron in the zinc alloy electrodeposit in order to achieve desired physical and chemical properties. The formation of dendrites on the substrate being plated at high current density areas has also been objectionable.

The present invention provides for an improved electrolyte for electrodepositing zinc alloys incorporating an additive agent which provides for improved grain-refinement, a reduction in dendrite formation, increase in adhesion and ductility while further unexpectedly increasing the codeposition of the alloying metal ions achieving a zinc alloy electrodeposit incorporating higher percentages of such alloying elements.

SUMMARY OF THE INVENTION

The benefits and advantages of the present invention in accordance with the composition aspects thereof are achieved by an aqueous acidic zinc alloy electrolyte containing zinc ions in conventional amounts in further combination with controlled amounts of at least one additional alloying metal ion selected from a group consisting of nickel, cobalt, iron and mixtures thereof. The electrolyte further contains as an essential constituent, an additive agent present in an amount effective to achieve improved physical characteristics of the zinc alloy deposit and to further enhance the codeposition of the alloying metal ion comprising a bath-soluble anionic carboxylated polyoxyalkylene compound derived from the carboxylation of:

(a) the polymerization of alkylene oxides selected from the group consisting of ethylene oxide, propylene oxide, glycidol, butylene oxide and mixtures thereof; and (b) the alkoxylation of mono and polyhydroxy compounds selected from the group consisting of hydroxyl containing alkyl, alkenyl, alkynyl, aryl, as well as mixtures thereof.

In addition to the foregoing constituents, the zinc alloy electrolyte may additionally contain various other additive agents of the types conventionally employed including buffering agents, supplemental brightening agents, bath soluble and compatible conductivity salts to increase the electrical conductivity of the electrolyte and the like.

In accordance with the process aspects of the present invention, a zinc alloy plating is electrodeposited on a conductive substrate employing the aforementioned aqueous acidic zinc alloy electrolyte which is controlled at a temperature typically ranging from about room temperature (60° F.) up to about 180° F. and is operated at an average cathode current density ranging from as low as about 1 up to as high as about 2000 amperes per square foot (ASF) or higher which will vary depending upon the specific type and composition of the electrolyte as well as the geometry and processing parameters employed in the plating operation.

Further benefits and advantages of the present invention will become apparent upon a reading of the Description of the Preferred Embodiments taken in conjunction with the specific examples provided.

DESCRIPTION OF THE PREFERRED EMBODIMENTS

The aqueous acidic zinc-alloy electrolyte in accordance with the composition aspects of the present invention contains zinc ions present in an amount effective to electrodeposit zinc from the electrolyte and generally can range from as low as about 15 g/l up to saturation, with concentrations of from about 15 to about 225 g/l being more usual. Preferably, for most applications, the zinc ion concentration is controlled within a range of about 20 to about 200 g/l. The maximum concentration of zinc ions will vary depending upon the temperature of the electrolyte with higher temperatures enabling use of higher concentrations. The zinc ion concentration will also vary depending upon the type of electrolyte employed which may be of the chloride, sulfate, mixed chloride-sulfate, sulfamate, as well as the fluoroborate types. In acid chloride-type electrolytes, the zinc ion concentration is generally controlled at a level within the lower end of the permissible range whereas in acid sulfate-type electrolytes, the zinc ion concentration is generally controlled at a level within the upper range of the permissible concentrations.

The zinc ions are introduced into the electrolyte in the form of soluble zinc salts such as a chloride, sulfate, sulfamate and/or fluoroborate salt in further combination with an acid such as sulfuric acid, hydrochloric acid, fluoroboric acid, sulfamic acid, or the like corresponding to the type of zinc salt employed. Generally the pH of the zinc-alloy electrolyte is controlled within a range of about 0 up to about 7 with a pH of from about 2 to about 6 being preferred.

In addition to the zinc ions, the electrolyte further contains controlled amounts of at least one of the alloying metal ions including nickel, cobalt, and/or iron which similarly are introduced in the form of bath soluble salts of the alloying metal including the chloride, sulfate, fluoroborate, acetate, or sulfamate as well as mixtures thereof. When nickel and/or cobalt are employed as the alloying metal, each can be employed in the bath in amounts of from about 0.5 g/l up to about 120 g/l to provide alloy deposits containing from about 0.1 up to about 30 percent by weight of nickel and/or cobalt. Preferably, the alloy deposit contains from about 0.25 percent to a total of about 15 percent of both nickel and/or cobalt, and the bath under such conditions contains nickel and/or cobalt ions in an amount usually ranging from about 3 g/l to about 65 g/l, respectively.

When iron comprises an alloying metal in the electrolyte, the operating iron ion concentration can range of from about 5 g/l up to about 140 g/l with concentrations of from about 40 g/l up to about 100 g/l being preferred.

When iron ions are present in the electrolyte which is only weakly acidic or either neutral, such as at a pH of from about 4 to about 6.5, it is generally preferred to incorporate conventional complexing or chelating agents to maintain an effective amount of the iron metal ions in solution. Chelating or complexing agents which are particularly satisfactory for this purpose include citric acid, gluconic acid, glucoheptanoic acid, tartaric acid, ascorbic acid, isoascorbic acid, malic acid, glutaric acid, muconic acid, glutamic acid, glycollic acid, aspartic acid, and the like as well as their alkaline metal, ammonium, zinc or ferrous salts.

While the iron ions are introduced into the electrolyte in the ferrous state, ferric ions are formed during the plating operation and it has been found that excessive amounts of ferric ions are objectionable resulting in the formation of striations in the zinc-alloy plated surface. Accordingly, it has been found desirable to control the ferric ion concentration at a level usually less than about 2 g/l. This can be accomplished by employing a soluble zinc anode in the electroplating bath or, alternatively, by immersing metallic zinc in the holding tank through which the electroplating solution is circulated. When no soluble anodes are employed or no zinc metal is provided in the holding tank, proper control of the ferric ion concentration can be achieved employing suitable bath soluble and compatible organic and/or inorganic reducing agents such as, for example, bisulfite, isoascorbic acid, monosaccharides and disaccharides such as glucose or lactose.

It will be appreciated from the foregoing, that electrolytes can be formulated to provide for appropriate binary, ternary or quaternary alloys containing predominently zinc and at least one of the other three alloying metal constituents.

When ternary alloy deposits are desired containing zinc-nickel-iron or zinc-cobalt-iron, the concentration of the metal ions in the electrolyte are usually controlled so as to provide an alloy containing from about 1 percent to about 25 percent iron in combination with either about 0.1 to about 20 percent by weight nickel or about 0.1 to about 12 percent cobalt and the balance essentially zinc.

In addition to the metal ions present in the electrolyte, the electrolyte further contains as an essential ingredient an additive agent comprising a bath-soluble anionic carboxylated polyoxyalkylene compound derived from the carboxylation of:

(a) the polymerization of alkylene oxides selected from the group consisting of ethylene oxide, propylene oxide, glycidol, butylene oxide and mixtures thereof; and (b) the alkoxylation of mono and polyhydroxy compounds selected from the group consisting of hydroxyl containing alkyl, alkenyl, alkynyl, aryl, as well as mixtures thereof.

The molecular weight of the additive agent or mixtures thereof is controlled to render the additive agent soluble in the electrolyte at the concentration desired. It will be appreciated that the additive agent may contain one terminal carboxyl group on the molecule or may contain more than one carboxyl group depending upon the degree of carboxylation and the number of reactive hydroxyl groups on the molecule. Commercially available carboxylated polyoxyalkylene compounds suitable for use as additive agents in accordance with the practice of the present invention include: carboxylated ethoxylated (18 moles) fatty alcohol containing 13 carbon atoms in the alcohol molecule; carboxylated ethoxylated lauryl alcohol containing 12 moles of ethylene oxide; and carboxylated ethoxylated nonyl phenol containing from about 16 to about 20 moles ethylene oxide.

The concentration of the additive agent in the electrolyte will vary depending upon the concentration and types of other bath constituents present, the desired alloy deposit composition, and whether the electrodeposit is to be employed for functional or decorative purposes. Generally speaking, the additive agent is employed in an amount effective to produce a refinement of the grain of the electrodeposit, to reduce the tendency to form dendrites during the electrodeposition process, to enhance the adhesion and ductility of the deposit to the substrate, and to either increase the codeposition of the alloying metal ions in the zinc alloy deposit or to regulate the alloy content at a more uniform, desired level. For this purpose, concentrations as low as about 0.005 up to about 20 g/l have been found usable while concentrations of from about 0.02 up to about 5 g/l are more typical and preferred for most uses.

The additive agent can be employed by itself in combination with the metal ions in the electrolyte to produce a semi-bright electrodeposit typical of a functional plating. When a decorative electrodeposit is desired having enhanced brightness, supplemental brightening agents of the types known in the art can be incorporated in the electrolyte in the usual amounts. Typical of supplemental brighteners that can be employed to further enhance the crystal structure and brightness of the zinc alloy electrodeposit are those disclosed in U.S. Pat. Nos. 4,170,526; 4,207,150; 4,176,017; 4,070,256 and 4,252,619. When employed, such supplemental brightening agents can be used at concentrations up to about 10 g/l with concentrations as low as about 0.001 g/l being effective. Typically, the concentration of the supplemental brightening agents range from about 0.01 up to about 5 g/l.

In addition to the foregoing essential and optional constituents, the electrolyte can further include supplemental additives such as buffers and bath modifiers such as boric acid, acetic acid, benzoic acid, salicylic acid, ammonium chloride and the like. Bath soluble and compatible salts such as ammonium sulfate, ammonium chloride or bromide, ammonium fluoroborate, magnesium sulfate, sodium sulfate, and the like can also be employed in amounts usually ranging from about 20 up to about 450 g/l to increase the electrical conductivity of the electrolyte. Typically, such conductivity salts comprise alkali metal salts such as chlorides, sulfates, sulfamates and fluoroborates.

In accordance with the process aspects of the present invention, the zinc-alloy electrolyte is employed to electrodeposit a desired zinc-alloy on a conductive substrate employing electrolyte temperatures ranging from about room temperature (60° F.) up to about 180° F. and more typically, from about 70° to about 140° F. The electrodeposition of the zinc alloy can be carried out at current densities ranging from as low as about 1 up to about 2000 ASF or higher. For chloride-type electrolytes, current densities of from about 1 to about 80 ASF are generally preferred whereas for sulfate-type electrolytes, current densities of from about 20 to about 2000 ASF can be employed. During the electrodeposition process, the bath or electrolyte is preferably agitated mechanically or by solution circulation or part movement. While air agitation can be employed, the use of air agitation with electrolytes containing iron ions is less desirable due to the tendency to increase the formation of ferric ions in the bath.

In order to further illustrate the electrolyte composition and process of the present invention, the following examples are provided. It will be understood that the examples are provided for illustrative purposes and are not intended to be limiting of the scope of the present invention as herein described and as set forth in the subjoined claims.

EXAMPLE 1

An aqueous acidic chloride-type electrolyte is prepared suitable for depositing a zinc-cobalt alloy containing 46 g/l of zinc chloride, 10.4 g/l of cobalt chloride hexahydrate, 175 g/l of sodium chloride as a conductivity salt, 20 g/l of boric acid as a buffering agent, and 1.75 g/l of sodium benzoate as a bath modifier. The pH of the electrolyte is adjusted at 5 employing hydrochloric acid or sodium hydroxide as necessary.

The bath is controlled at a temperature of 70° F. and standard clean steel Hull Cell panels were plated at a current of 1 ampere for a period of ten minutes without any agitation. A dull, black to grey-black non-uniform deposit was obtained having a grainy appearance. Deposit is dendritic and not commercially acceptable. Upon analysis, the alloy deposit on the panel within the current density range of 20–40 ASF contained 7.44 percent by weight cobalt; in the 10–20 ASF current density range, the alloy contained 6.50 percent by weight cobalt; and in the current density range of 0–10 ASF, the alloy deposit contained 2.61 percent by weight cobalt.

EXAMPLE 2

To illustrate the effect on the alloy content of known technology using nonionic addition agents, to the electrolyte of Example 1, 2 g/l of the commercial nonionic additive agent comprising ethoxylated ($C_{12}$–$C_{15}$) fatty alcohol containing 18 moles ethylene oxide, a standard Hull cell test panel was again plates under the same conditions as in Example 1, and the resultant zinc alloy deposit was uniform silver-white, semi bright within the current density range of 0.1–45 ASF. In the 20–40 ASF current density range, the alloy contained 0.94 percent by weight cobalt; in the 10–20 ASF current density range, the alloy contained 0.56 percent by weight cobalt; and in the 0–10 ASF current density range, the alloy contained 0.30 percent by weight cobalt. This level of cobalt supression is too severe to provide the doubling of corrosion resistance desired from such an alloy. In addition, the electrolyte requires cooling to stay stable, for the addition agent clouds out at 105° F., when the addition agent loses solubility and therefore its effectiveness.

EXAMPLE 3

To the electrolyte as described in Example 1, 2 g/l of the additive agent of the present invention was added comprising a carboxylated ethoxylated C-13 fatty alcohol containing 18 moles ethylene oxide. A standard clean Hull Cell panel was again plated under the same conditions as described in Example 1 and the resultant zinc alloy deposit was of a uniform silver-white, semi-bright appearance within the current density range of 0.1–40 ASF. This deposit is commercially acceptable for use. In the 20–40 ASF current density range, the alloy contained 2.55 percent by weight cobalt; in the 10–20 ASF current density range, the alloy contained 1.15 percent by weight cobalt, and in the 0–10 ASF current density range, the alloy contained 0.52 percent by weight cobalt. This commercially acceptable alloy gives the required corrosion resistance to make it economically feasible. This electrolyte was stable at elevated temperatures (140° F.) requiring no cooling in commercial operations.

EXAMPLE 4

To the electrolyte as described in Example 1, 2 g/l of the additive agent of the present invention was added comprising a carboxylated ethoxylated lauryl alcohol containing 12 moles ethylene oxide. A clean steel Hull Cell panel was again plated under the same conditions as described in Example 1 producing a uniform, silver-white, semi-bright commercially acceptable alloy deposit over the current density range of 0.1–40 ASF. Upon analysis, the alloy deposit in the 20–40 ASF current density range contained 2.01 percent by weight cobalt; in the 10–20 ASF current density range, contained 1.43 percent by weight cobalt; and in the 0–10 ASF current density range contained 0.52 percent by weight cobalt. This electrolyte was stable at elevated temperatures of 140° F. requiring no cooling in commercial operations.

EXAMPLE 5

To the electrolyte as described in Example 1, 2 g/l of the additive agent of the present invention was added comprising a carboxylated ethoxylated nonyl phenol containing 16–20 moles ethylene oxide. Standard clean steel Hull Cell panels were plated under the same conditions as described in Example 1 producing a uniform, silver-white, semi-bright commercially acceptable alloy deposit between the current density range of 0.1–50 ASF. Upon analysis, the alloy deposit within the 20–50 ASF current density range contained 2.38 percent by weight cobalt, within the 10–20 ASF current density range, contained 1.13 percent by weight cobalt, and within the current density range of 0–10 ASF, contained 0.52 percent by weight cobalt and the balance zinc. This electrolyte was stable at elevated temperatures of 145° F. requiring no cooling in commercial operations.

EXAMPLE 6

To the electrolyte as described in Example 2, supplemental brightening agents were added comprising 60 mg/l benzylidene acetone, 20 mg/l butyl nicotinate dimethyl sulfate quaternary and 50 mg/l 4-phenyl-4-sulfobutan-2-one-sodium salt. Standard clean Hull Cell panels were again plated in the electrolyte under the same conditions of Examples 1 and 2 and uniform brilliantly bright alloy deposits were obtained over the entire current density range without significant change in the concentration of the cobalt in the alloy.

EXAMPLE 7

The supplemental brightening agents as described in Example 6 were added to the electrolyte of Example 3 in the same concentrations and Hull Cell panels were again plated under the same conditions. Uniform brilliantly bright alloy deposits were obtained over the entire current density range without significantly changing the cobalt concentration in the zinc-cobalt alloy.

EXAMPLE 8

The same supplemental brightening agents as described in Example 6 were employed in the same concentrations in the electrolyte of Example 4 and clean steel Hull Cell panels were again plated under the same conditions as described in Examples 1 and 4. Uniform, brilliantly bright zinc alloy electrodeposits were obtained over the entire current density range without significantly changing the concentration of the cobalt in the zinc-cobalt alloy.

EXAMPLE 9

An aqueous acidic electrolyte is prepared suitable for electrodepositing a zinc-iron alloy containing 110 g/l of zinc sulfate monohydrate, 310 g/l of ferrous sulfate heptahydrate and 250 mg/l of the additive agent comprising the ammonium salt of carboxylated ethoxylated (12 moles ethylene oxide) lauryl alcohol. The electrolyte was controlled at a temperature of 122° F. and at a pH of about 2.

The electrolyte was employed for electrodepositing a zinc-iron plate on a rotating steel rod cathode of a diameter of ¼ inch providing a surface velocity of 200 feet per minute simulating high speed plating conditions. The average cathode current density was about 500 ASF. The electrodeposition was carried out for a period of about 50 seconds producing a plating of about 0.5 mil thick which was lustrous, fine-grained and of semi-bright appearance. No dendrites were present at the edges of the cathode. Upon analysis, the iron content of the zinc-iron alloy ranged from about 11 to about 13 percent by weight with the balance zinc. A soluble zinc anode was employed during the electrodeposition process.

EXAMPLE 10

An aqueous acidic electrolyte is prepared suitable for depositing a zinc-nickel alloy containing 205 g/l zinc sulfate monohydrate, 310 g/l nickel sulfate hexahydrate, 36 g/l sulfuric acid and 15 mg/l of the additive agent comprising the sodium salt of carboxylated ethoxylated (20 moles ethylene oxide) nonyl phenol. The electrolyte was of a pH less than 1 and was controlled at a temperature of 140°-150° F.

A stationary steel cathode was electrodeposited while the electrolyte was pumped over it to provide a surface velocity of 325 feet per minute at a cathode current density of about 1000 ASF for a period of 13 seconds to produce an alloy plate of about 0.25 mil thickness. An insoluble anode comprising lead containing 0.01 percent silver was employed. The resultant zinc-nickel electrodeposit suitable for functional uses was of an adherent, fine-grained grey appearance and upon analysis contained 8.27 percent by weight nickel. The zinc-alloy deposit as produced under these conditions with the addition agent of the present invention provided for a 50 percent improvement in the corrosion resistance over standard, functional, commercial zinc of equivalent thickness as measured by the atmospheric corrosion test identified as ASTM B-537.

EXAMPLE 11

An aqueous acidic electrolyte is prepared suitable for depositing a zinc-cobalt alloy containing 450 g/l zinc sulfate monohydrate, 60 g/l cobalt sulfate heptahydrate, 36 g/l sulfuric acid, and 15 mg/l of the additive agent comprising the sodium salt of carboxylated ethoxylated (20 moles ethylene oxide) nonyl phenol.

A steel cathode strip was electroplated employing an electrolyte temperature of from 105°-110° F. for a period of 13 seconds to provide a zinc-cobalt alloy deposit of about 0.25 mil thickness. The cathode was physically moved at a velocity of 325 feet per minute employing a current density of 1000 ASF. An insoluble lead alloy anode was employed containing 0.01 percent silver. The resultant functional zinc-cobalt alloy deposit was of a grain-refined, light grey appearance and commercially acceptable for functional applications. Upon analysis, the concentration of cobalt in the zinc-cobalt alloy ranged from 0.25 to 0.3 percent by weight.

A similar test employing the same electrolyte under these same conditions but without the presence of the additive agent produced a zinc-alloy deposit containing only 0.1 percent by weight cobalt. The foregoing example demonstrates the unexpected contribution of the additive agent for the codeposition of the alloying agent. The increase in the cobalt concentration in the alloy provides for a 25 percent increase in the atmospheric corrosion resistance of the plated cathode under ASTM B-537 testing procedure.

EXAMPLE 12

An aqueous acidic electrolyte is prepared suitable for depositing a zinc-nickel-cobalt-iron alloy deposit containing 100 g/l zinc sulfate monohydrate, 50 g/l nickel sulfate hexahydrate, 50 g/l cobalt sulfate heptahydrate and 100 g/l ferrous sulfate heptahydrate. The resultant electrolyte was at a pH of 4.5 and was controlled at a temperature within the range of 122°-130° F.

A rotating steel rod cathode as described in Example 9 rotating to provide a surface speed of 300 feet per minute was plated at a current density of 1000 ASF employing an insoluble lead anode. The deposit was 6 micrometers thick and of a satiny grey appearance. Upon analysis, the alloy deposit contained 74.3 percent by weight zinc; 14.3 percent by weight iron; 6.4 percent by weight cobalt; and 5.0 percent by weight nickel.

EXAMPLE 13

To the electrolyte as described in Example 12, 1 g/l of an additive agent was added comprising the sodium salt of carboxylated ethoxylated (16 moles ethylene oxide) nonyl phenol. A rotating steel rod cathode was plated under the same conditions as described in Example 12 producing a zinc alloy deposit which was of a semi-bright appearance. Upon analysis, the zinc alloy contained 63 percent by weight zinc, 19.5 percent by weight iron, 10.1 percent by weight cobalt and 7.4 percent by weight nickel. A comparison of the alloy composition obtained in accordance with Example 13 relative to that of Example 12 devoid of any additive agent clearly evidences the improved codeposition of the alloying metal ions achieved when the additive agent is present.

EXAMPLE 14

An aqueous acidic electrolyte was prepared suitable for electrodepositing a decorative corrosion resistant zinc-cobalt alloy deposit on bolts in a barrel plating operation. The electrolyte contained 47 g/l zinc chloride, 9.4 g/l cobalt chloride hexahydrate, 136 g/l sodium chloride, 23 g/l boric acid, 0.8 g/l sodium benzoate, a mixture of the additive agents comprising 0.5 g/l of the sodium salt of carboxylated ethoxylated (20 moles ethylene oxide) nonyl phenol and 1.5 g/l of the sodium salt of carboxylated ethoxylated (18 moles ethylene oxide) of a fatty C-13 alcohol. In addition, the electrolyte contained 0.2 g/l of benzylidene acetone as a supplemental brightening agent.

Cleaned bolts were plated in a conventional rotating plating barrel at an average cathode current density of 6 ASF and at an electrolyte temperature of about 78° F. Upon inspection, the bolts were observed to have a very bright and decorative zinc-cobalt alloy plating on the surfaces thereof which upon analysis contained an average of 0.55 percent cobalt by weight with the balance zinc.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. An aqueous acidic electrolyte suitable for electrodepositing zinc alloys on a substrate comprising zinc ions and at least one additional metal ion selected from the group consisting of nickel, cobalt, iron and mixtures thereof present in an amount sufficient to electrodeposit a zinc alloy, and, for providing improved grain-refinement and enhancing the codeposition of the alloying metals in the zinc alloy deposit, an effective amount of an additive agent comprising a bath-soluble anionic carboxylated polyoxyalkylene compound derived from the carboxylation of:

(a) the polymerization of alkylene oxides selected from the group consisting of ethylene oxide, propylene oxide, glycidol, butylene oxide and mixtures thereof; and (b) the alkoxylation of mono and polyhydroxy compounds selected from the group consisting of hydroxyl containing alkyl, alkenyl, alkynyl, aryl, as well as mixtures thereof.

2. The electrolyte as defined in claim 1 in which said zinc ions are present in an amount of about 15 g/l up to saturation.

3. The electrolyte as defined in claim 1 in which said additional metal ion comprises nickel, cobalt, and mixtures thereof present in an amount of about 0.5 to about 120 g/l.

4. The electrolyte as defined in claim 1 in which said additional metal ion comprises iron ions present in an amount of about 5 to about 140 g/l.

5. The electrolyte as defined in claim 1 in which said additional metal ion comprises iron ions and said electrolyte further includes a complexing agent present in an amount sufficient to maintain an effective amount of iron ions in solution.

6. The electrolyte as defined in claim 1 in which said additional metal ion comprises iron ions and said electrolyte further includes a reducing agent present in an amount effective to reduce at least a portion of ferric ions to the ferrous state.

7. The electrolyte as defined in claim 1 further containing conductivity salts present in an amount sufficient to increase the electrical conductivity of the electrolyte.

8. The electrolyte as defined in claim 1 further including hydrogen ions present in an amount to provide a pH of about 0 to about 7.

9. The electrolyte as defined in claim 1 further including hydrogen ions present in an amount to provide a pH of about 2 to about 6.

10. The electrolyte as defined in claim 1 in which said additive agent is present in an amount of about 0.005 to about 20 g/l.

11. The electrolyte as defined in claim 1 in which said additive agent is present in an amount of about 0.02 to about 5 g/l.

12. The electrolyte as defined in claim 1 further including a supplemental brightening agent present in an amount up to about 10 g/l.

13. A process for electrodepositing a zinc alloy on a substrate comprising the steps of contacting a cathodically electrified substrate with an aqueous acidic electrolyte comprising zinc ions and at least one additional metal ion selected from the group consisting of nickel, cobalt, iron and mixtures thereof present in an amount sufficient to electrodeposit a zinc alloy, and, for providing improved grain-refinement and enhancing the codeposition of the alloying metals in the zinc alloy deposit, an effective amount of an additive agent comprising a bath-soluble anionic carboxylated polyoxyalkylene compound derived from the carboxylation of:

(a) the polymerization of alkylene oxides selected from the group consisting of ethylene oxide, propylene oxide, glycidol, butylene oxide and mixtures thereof; and (b) the alkoxylation of mono and polyhydroxy compounds selected from the group consisting of hydroxyl containing alkyl, alkenyl, alkynyl, aryl, as well as mixtures thereof;

and continuing the electrodeposition of the zinc alloy until the desired thickness is obtained.

14. The process as defined in claim 13 including the further step of controlling the temperature of the electrolyte within a range of about 60° to about 180° F.

15. The process as defined in claim 13 including the further step of controlling the temperature of the electrolyte within a range of about 70° to about 140° F.

16. The process as defined in claim 13 in which the step of electrodepositing the zinc alloy is performed at an average cathode current density of about 1 to about 2000 ASF.

17. The process as defined in claim 13 including the further step of controlling the concentration of the zinc ions and either one of the nickel and cobalt ions to provide a zinc alloy containing about 0.1 to about 30 percent by weight nickel and/or cobalt.

18. The process as defined in claim 13 including the further step of controlling the concentration of zinc ions, iron ions, and either one of the cobalt ions and nickel ions to electrodeposit a zinc alloy containing from about 1 to about 25 percent by weight iron, about 0.1 to about 20 percent nickel or about 0.1 to about 12 percent cobalt.

19. The process as defined in claim 13 including the further step of controlling the concentration of additive agent within a range of about 0.005 to about 20 g/l.

20. The process as defined in claim 13 including the further step of controlling the concentration of additive agent within a range of about 0.02 to about 5 g/l.

* * * * *